United States Patent [19]

Bodner

[11] 4,312,510

[45] Jan. 26, 1982

[54] BOARD GAME APPARATUS

[76] Inventor: Richard Bodner, Box 199, Montezuma Rte., Las Vegas, N. Mex. 87701

[21] Appl. No.: 102,979

[22] Filed: Dec. 11, 1979

[51] Int. Cl.[3] ..... A63F 3/00

[52] U.S. Cl. ..... 273/256; 273/284; 273/288

[58] Field of Search ..... 273/256, 278

[56] References Cited

U.S. PATENT DOCUMENTS

| | | | |
|---|---|---|---|
| 1,165,688 | 12/1915 | Mans | 273/262 |
| 2,174,058 | 9/1939 | McGennis | 273/256 |
| 2,673,738 | 3/1954 | Jenkins | 273/256 |
| 2,691,528 | 10/1954 | Laidlaw | 273/256 |
| 2,794,642 | 6/1957 | O'Neill | 273/256 |
| 3,058,747 | 10/1962 | Nemetsky | 273/256 |
| 3,163,423 | 12/1964 | Jackson | 273/256 |
| 3,198,521 | 8/1965 | Kramer | 273/256 |
| 3,237,948 | 3/1966 | Murray | 273/256 |
| 3,539,189 | 10/1970 | Shelton | 273/256 |
| 3,740,037 | 6/1973 | deBono | 273/256 |

*Primary Examiner*—Richard C. Pinkham
*Assistant Examiner*—Carl Moy
*Attorney, Agent, or Firm*—Steinberg & Raskin

[57] ABSTRACT

A board game apparatus whose play simulates the various aspects of market trading and in the preferred embodiment simulates in relative detail the aspects of the trading of shares of stock in various markets of a market exchange. The game board has a continuous track defined by a plurality of spaces, the majority of which each constitute a market which belongs to one of a set of market groups. A set of value scales, preferably also provided on the game board, and each corresponding to one of the market groups has indicia associated therewith for indicating the value of shares of the particular markets which belong to the corresponding market group. A plurality of value indicating marker means are provided, each corresponding to a particular one of the markets and are located on respective value scales to indicate a particular current value for the shares of the corresponding markets. In order to closely simulate the various aspects of actual market operations, structure is provided for directing the movement of the value indicating marker means on their respective value scales in a manner such that various factors such, for example, as purchases and sales of shares, news flashes, mergers, etc., will affect the value of the shares of the various markets.

14 Claims, 22 Drawing Figures

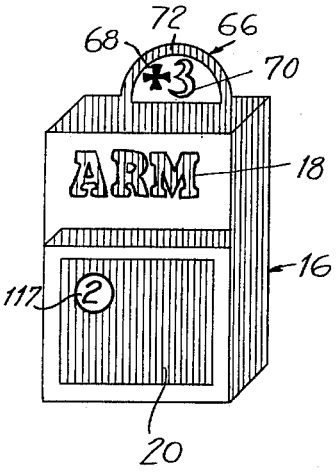
FIG. 2a
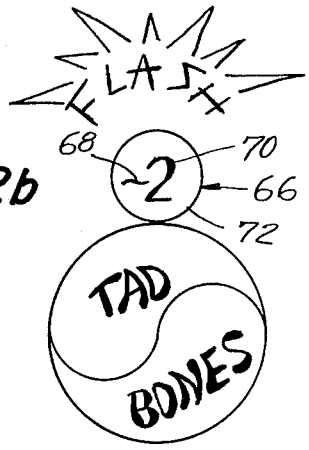
FIG. 2b
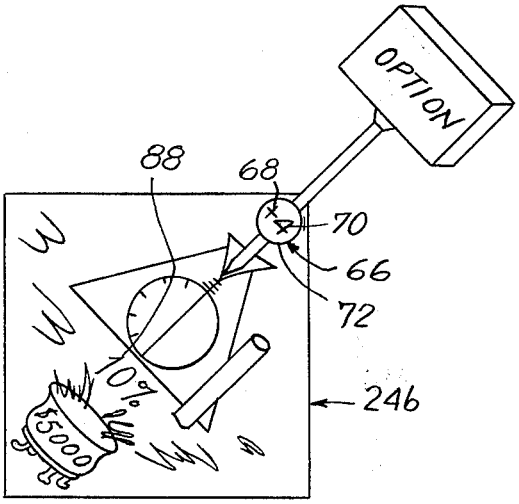
FIG. 2d
FIG. 2c
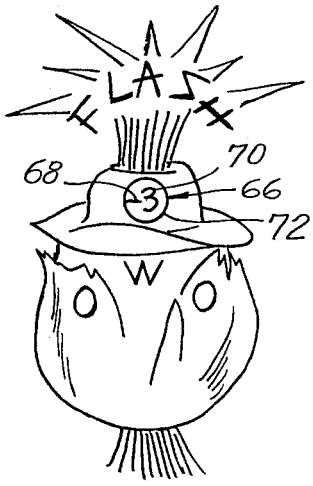

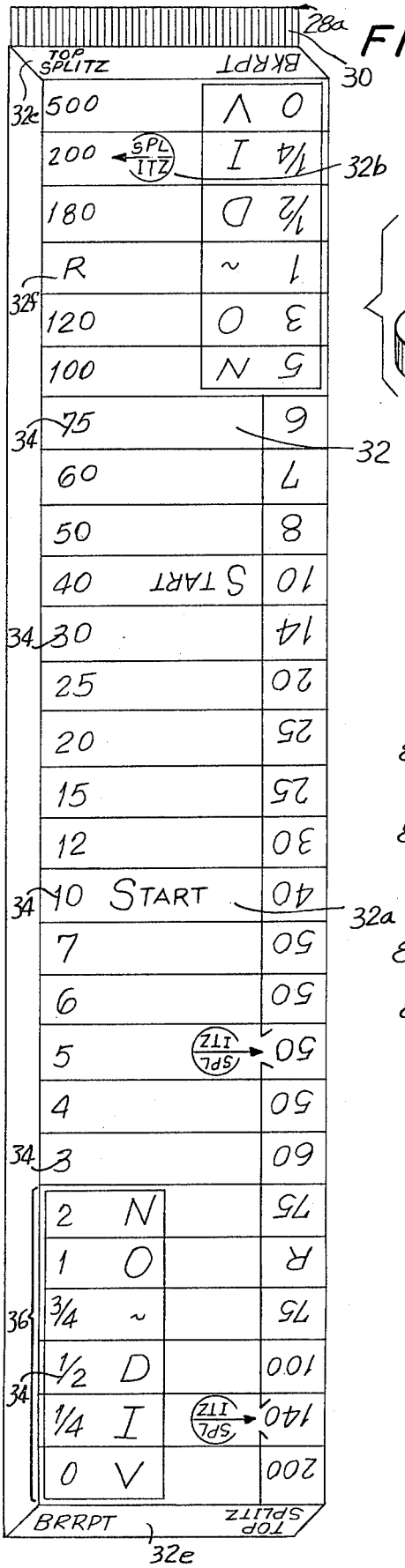
FIG. 3a
FIG. 3c
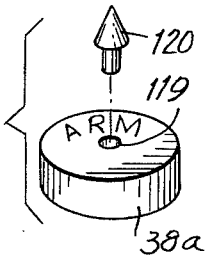
FIG. 3b
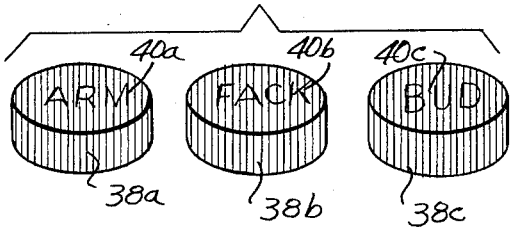
FIG. 4
42
| FISCAL YEAR of Transactor | NUMBER OF SHARES in The Transaction | NUMBER OF TICS of resulting MARKER-EFFECT |
|---|---|---|
| 80a 1. | 10- 500<br>500- 1,000<br>1,000- x | 1 tic<br>± 2 tics<br>3 tics |
| 80b 2. | 50- 1,000<br>1,000- 5,000<br>5,000- x | 1 tic<br>± 2 tics<br>3 tics } 86 |
| 80c 3. | 100- 5,000<br>5,000- 10,000<br>10,000- x | 1 tic<br>± 2 tics<br>3 tics |
| 80d 4. | 500- 10,000<br>10,000- 50,000<br>50,000- x | 1 tic<br>± 2 tics<br>3 tics |
| 80e 5 or more. | 1,000-50,000<br>50,000-100,000<br>100,000-500,000<br>500,000 x | 1 tic<br>± 2 tics<br>3 tics<br>4 tics |
82 84
FIG. 5
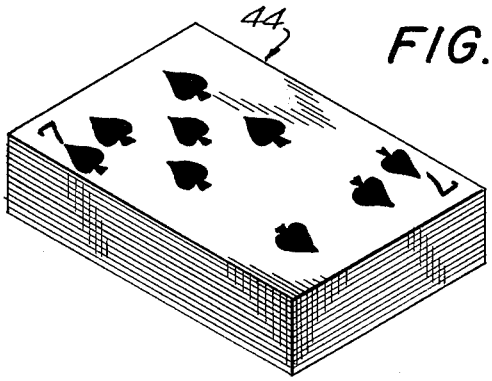

FIG. 6a
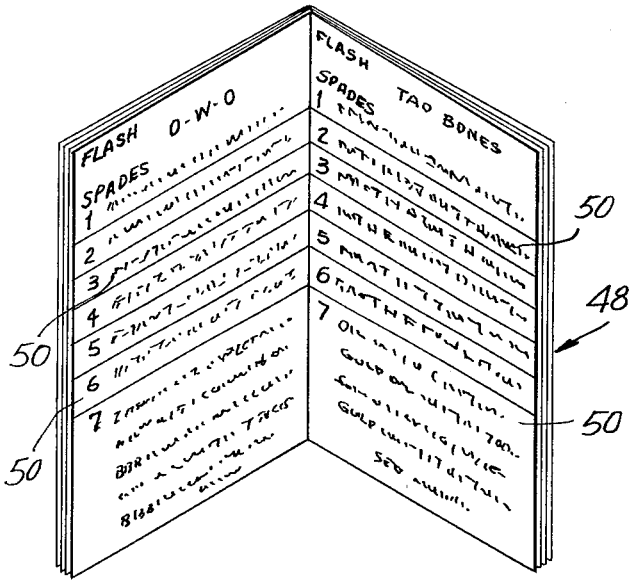
FIG. 11
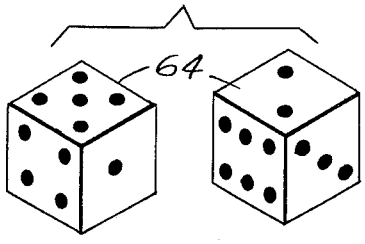
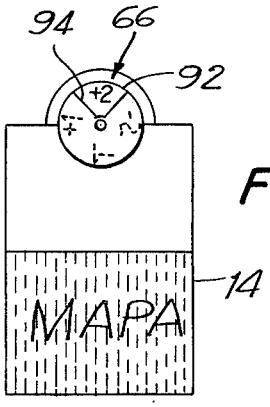
FIG. 12
FIG. 9
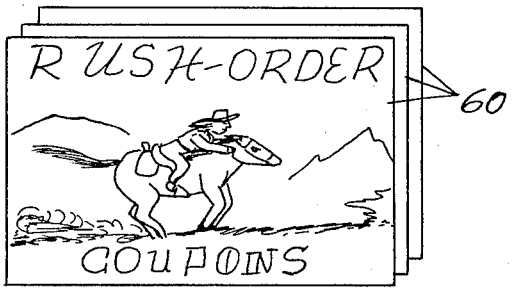
FIG. 13
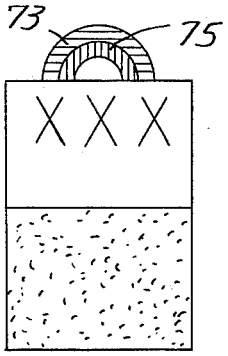
FIG. 10
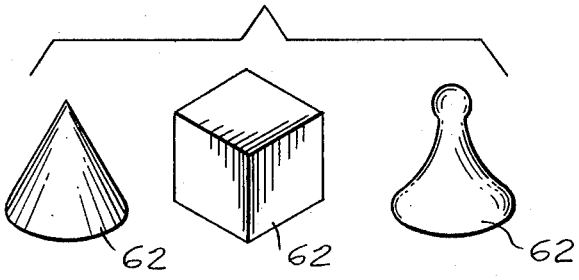

FIG. 7

106 108 52 110

| CONTROL: | | SHARE-Level: | | |
|---|---|---|---|---|
| | COLOR: | "loose" 100¢up | "snug" 1,000¢up | "tight" 10,000¢up |
| Single COMPANY (102) | Red or Yellow: | $ 1,000 | $ 5,000 | $ 50,000 |
| | Blue or Orange: | 2,000 | 10,000 | 100,000 |
| | Green or Purple: | 3,000 | 15,000 | 150,000 |
| Entire INDUSTRY (104) | Red or Yellow: | $ 3,000 | $ 15,000 | $ 150,000 |
| | Blue, Orange, or Green: | 5,000 | 25,000 | 250,000 |
| | Purple: | 10,000 | 50,000 | 500,000 |

FIG. 8a

BANK ACCOUNT STATEMENT — 54

Initial Handout: 10,000

| Current Balance | Current Balance | Current Balance | Current Balance |
|---|---|---|---|
| 10,000 | | | |

FIG. 8b

56

PORTFOLIO ACCOUNT SHEET

| reds: | | | yellows: | | | blues: | | | oranges: | | | | greens: | | purples: | | |
|---|---|---|---|---|---|---|---|---|---|---|---|---|---|---|---|---|---|
| ARM | BUD | FACK | ABC | OUI | PLOT | PAL | BBB | RRR | SOL | BAG | NUC | GULP | EATS | JAW | MAPA | LALA | DAWG |
| | | | | | | | | | | | | | | | | | |

FIG. 8c

58

OPTIONS TICKET ON:

SHARES company STRIKE-PRICE (year) total cost (received)

OPTIONS TICKET ON:

90a 90b 90c 90d 90e 90f

BOARD GAME APPARATUS

BACKGROUND OF THE INVENTION

This invention relates, generally, to board game apparatus whose play simulates the various aspects of actual market operations and, more particularly, to board game apparatus useful for both entertainment and educational purposes for simulating the operations of a market exchange which employs skill, strategy, chance and decision-making factors in its play.

Board game apparatus are well known which attempt to simulate the various aspects of market exchange operations. Thus, board game apparatus wherein a plurality of markets are represented on a playing board are known and wherein the play comprises the movement of player tokens on a continuous track in conjunction with the purchase and sale of such markets.

For example, a board game apparatus is disclosed in U.S. Pat. No. 2,691,528, wherein a stock market is simulated and includes a series of value scales, each of which represents a stock, value indicator marker means located on each value scale for indicating the value of the stock and a continuous track defined by a series of areas or spaces at least some of which represent various stocks. As player tokens are moved around the track, the values of the various stocks as indicated by the location of the marker means on the value scales are changed in accordance with indicia provided in the track defining areas.

Although the game apparatus disclosed in the above-identified patent attempts the simulation of the operations of a market exchange wherein the values of shares rise or fall during play of the game, this game does not provide for the actual simulation of a market exchange in that in actual or real life situations, many factors all interrelate to cause the value of market shares to rise or fall. For example, it is a fact that markets are often related to each other in some form or fashion. For example, it is well known that there are several oil companies, each representing a separate market but each being related to the others in that certain factors will influence the value of the shares of all of these markets simultaneously. Thus, political events may affect the price of all of the markets in a particular related market group and, similarly, business transactions between two or more companies may influence the value of the shares of both of these companies. Purchases or sales of large blocks of shares in a particular market will influence the value of those shares as will other so-called "technical" factors. In other words, operations of various recognized market influences will affect the value of shares associated with a single market, while others will affect the value of shares of a group of related markets while still other influences will affect the values of shares of all of the markets on the exchange. Such feature is not provided in any of the conventional board game apparatus presently available.

Further, existing board game apparatus of the above described type do not provide means by which decisions as to market transactions are affected by the "control" by a particular player of a market or group of related markets. Although such "control" features are known as represented by U.S. Pat. No. 2,026,082 ("Monopoly"), such feature is not employed in a manner whereby market exchange transactions will be governed in a realistic manner thereby.

Still further, conventional board game apparatus do not take into account the effect that the passage of time has on the value of markets. Thus, it is well known that in periods of inflation, the variation in value of shares of particular markets with time must be carefully considered in connection with any transaction in such markets. The concept of time also becomes important in connection with the purchase and sale of so-called "options". Thus, in the actual or real-life situation the value of an option will fluctuate according to the passage of time. None of the existing board game apparatus provides for such factors.

SUMMARY OF THE INVENTION

Accordingly, one object of the present invention is to provide a new and improved board game apparatus for simulation of a market exchange whereby the various market value influencing factors which operate in real world market exchanges are accurately simulated during game play.

Another object of the present invention is to provide a new and improved board game apparatus for simulating a market exchange wherein the operations of various value-influencing factors will alter in a realistic manner the values of single markets, of several related markets which belong to respective market groups and of all markets in the exchange.

Still another object of the present invention is to provide a new and improved board game apparatus for simulating a market exchange wherein market transactions are governed at least in part by the control of markets or groups of related markets by a particular player.

A further object of the present invention is to provide a new and improved board game apparatus for simulating a market exchange wherein the passage of time and inflationary effects are simulated through appropriate fluctuations in market values.

Yet another object of the present invention is to provide a new and improved board game apparatus for simulating a market exchange wherein the game apparatus is adapted to provide a series of game situations which are progressively more sophisticated so that the apparatus can be used by players in a relatively broad range of ages and market experience.

Briefly, in accordance with the present invention, these and other objects are attained by providing a board game apparatus comprising a game board having a continuous track defined by a plurality of spaces on a playing area thereof, each of a majority of the spaces constituting a market which belongs to one of a set of market groups. A set of value scales are provided, each of which is associated with a corresponding one of the groups of related markets. A series of indicia are associated with each value scale for indicating the value of shares of the particular markets which belong to the corresponding market group. A plurality of value indicating marker means are provided, each of which is associated with a corresponding one of the markets. Each value indicating marker means is moveably located on a respective value scale so as to indicate the current value of the shares of that particular market. Value altering means which are associated with the game board and with various associated game elements are provided which direct the movement of the value indicating marker means on their respective value scales to thereby alter the value of the shares of the market corresponding thereto. The value altering means are such that the values of a single market can be altered or the values of the markets belonging to a particular market group can be altered or the value of all of the markets can be altered. The value altering means reflect the various market value influencing factors which operate in real world market exchanges such, for example, as purchases and sales of blocks of market shares, news events which affect particular markets or market groups, control of markets or market groups by particular players, time factors, etc.

As will be seen below, the illustrated preferred embodiment of the board game apparatus utilizes a market exchange wherein shares in various listed companies belonging to different industry groups are traded. However, it is understood that other market exchanges such, for example, as commodities (such as grains, precious metals or the like), may be employed in the present invention in lieu of industries. In such cases, the markets would represent particular commodities, such as gold, silver, wheat or the like. In this connection, the term "market" is understood as signifying and definable entity comprising a plurality of units or shares whose values fluctuate and which are regularly exchanged at rates which fluctuate with respect to one or more other units of exchange also deemed to have value.

It should be noted, however, that an essential feature of the present invention is that the individual markets are grouped according to associational or technical similarities and that the units or shares of each market have a fluctuating value with respect to each other. Further, it is essential that a sufficient number of shares be available in each market as to insure a close approximation to the real life characteristic of market exchanges. This may be accomplished by providing an infinite number of shares for each market or by setting an authorized limit sufficiently large such, for example, as a million shares of each market or by limiting the period of play so that sufficient numbers of shares are available for a particular game. In this connection, it is noted that the market shares need not be represented by physical structures so long as means are provided such, for example, as portfolio account sheets, wherein player holdings of such shares can be recorded.

The illustrated preferred embodiment comprises game apparatus which may be played in alternate forms. For example, in a first form of play, a market exchange is simulated from the perspective of an individual investor with a focus on buying and selling market shares for profits and/or dividends. In a second form of play, strategies in connection with transactions in market shares are affected by the existence of markets and/or market groups which are controlled by an individual player. Thus, control of a particular market is obtained by that player holding the most shares therein (beyond a certain predetermined minimum) while control of a market group is obtained by a player controlling every market which belongs to that market group. In this second form of play, the landing of a player token on a space designating a controlled market results in the landing player paying the controlling player fees which represent costs of goods or services associated with that market, such fees being determined according to the particular market group of the controlled company, the level of control, i.e., the amount of shares owned by the controlling player, and according to whether the market is controlled singly or as part of a market group. Further, fees are payable between individual players upon one player taking control of a market from another player.

Further, each game form as described above may be played at various levels of sophistication ranging from simple individual share transactions to levels wherein the players manipulate a wide range of investment strategies wherein taxations and the like must be contended with.

DESCRIPTION OF THE DRAWINGS

A more complete appreciation of the present invention and many of the attendant advantages there will be readily appreciated as the same becomes better understood by reference to the following detailed description when considered in connection with the accompanying drawings in which:

FIG. 2*a* is a detail view of one of the track defining spaces shown on the game board of FIG. 1, which space constitutes a typical market;

FIG. 2*b* is a detail view of a track-defining space illustrated on the game board of FIG. 1 which comprises one type of information entry space;

FIG. 2*c* illustrates another type of information entry space which comprises a track defining space on the game board;

FIG. 2*d* illustrates a typical option purchase space comprising one of the track-defining spaces illustrated on the game board of FIG. 1;

FIG. 3*a* is a detail view of one of the value scales associated with the game board of FIG. 1;

FIG. 3*b* illustrates three typical value indicating marker means comprising a part of the board game apparatus;

FIG. 3*c* illustrates one of the value indicating marker means shown in FIG. 3*b* having a player indicating marker affixable thereto;

FIG. 4 illustrates a market action pressure table comprising one value altering means which directs the altering of the value of market shares resulting from purchases and sales thereof;

FIG. 5 is a view of a deck of cards comprising chance means for directing a player to particular market value influence information entries upon the player landing on one of the information entry spaces illustrated in FIGS. 2*b* and 2*c;*

FIG. 6*a* is a view schematically showing a series of typical market value influence information entries;

FIG. 7 is a view showing a market revenue and acquisition payment fee schedule for use in connection with the game apparatus when player control of markets or market groups is taken into account during the play of the game;

FIG. 8*a* is a partial view of a bank account statement for use by each player to keep a record of his current balance during player of the game;

FIG. 8*b* is a partial view of a portfolio account sheet for use by a player to record holdings in the various market shares purchased and sold;

FIG. 8*c* is a partial view of an option ticket for use by a player in recording information relative to options purchased during the course of the game;

FIG. 9 is a view of rush order coupons comprising elements of the game apparatus;

FIG. 10 is a view of several player tokens for use in movement around the track during the play of the game;

FIG. 11 is a view of dice for controlling the movement of the player tokens around the track;

FIG. 12 is a view of one of the track defining spaces wherein the value altering indicia can be varied by means associated therewith; and FIG. 13 is a view of an alternate embodiment of the track defining space defining a typical market.

DESCRIPTION OF THE PREFERRED EMBODIMENTS

Figure 1:
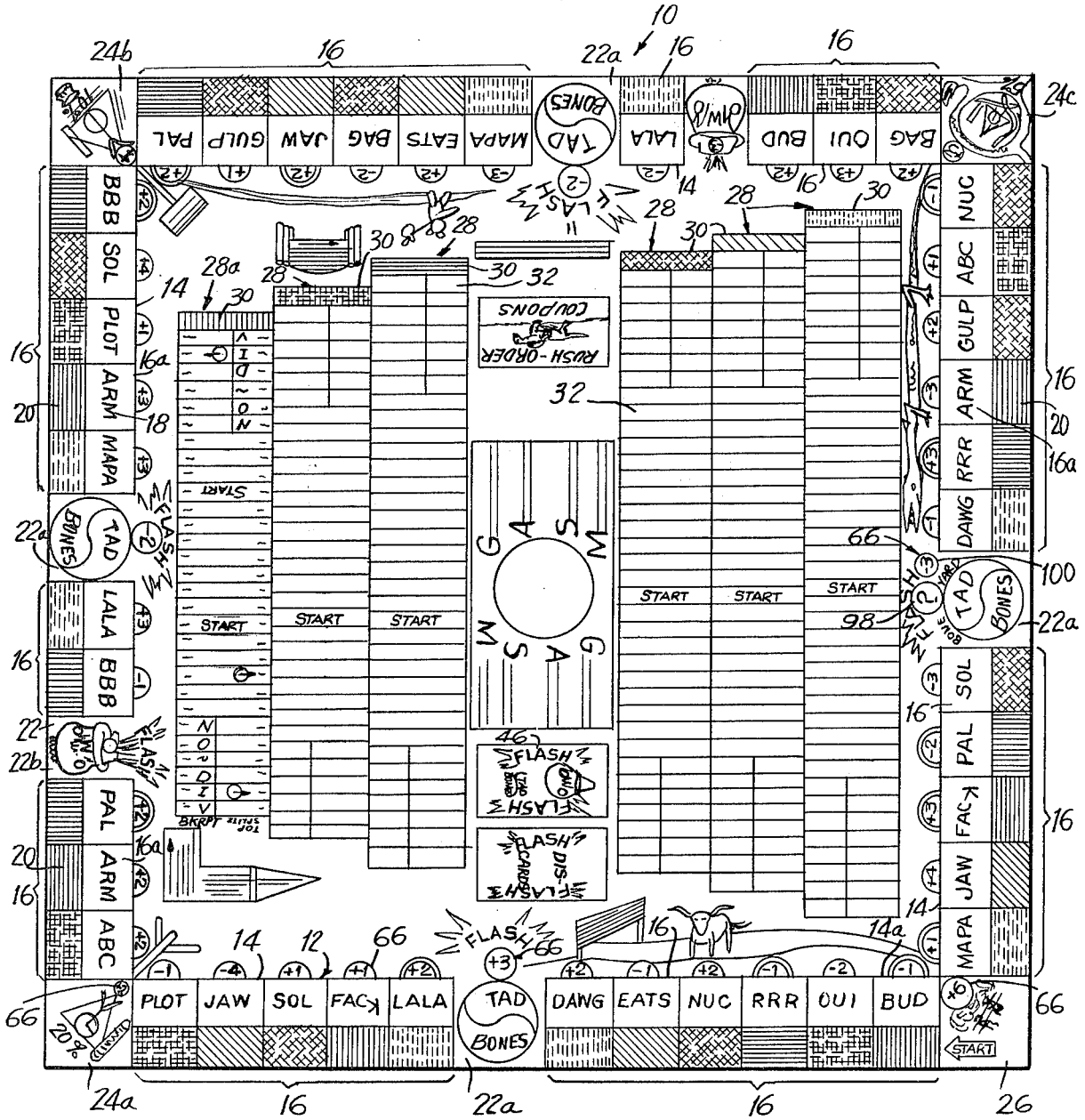
FIG. 1 is a plan view of a game board according to the present invention illustrating the various elements of the board involved in the play of a typical game.

Referring now to the drawings wherein like reference characters designate identical or corresponding parts throughout the several views and more particularly to FIG. 1, the game board of the present invention, generally designated 10, is preferably of the usual flat rectangular form and is provided at its peripherally extending area with a continuous track or token pathway 12 defined by a plurality of spaces, generally designated 14. The majority of spaces 14 represent various markets and such market spaces are designated 16. In the illustrated preferred embodiment there are 42 market spaces 16, these market spaces having indicia 18 (FIG. 2*a*) designating a particular market. In the present embodiment, the market constitutes a company and the indicia 18 constitutes the company symbol. As will be seen in FIG. 1, each market is represented on the game board 10 by several market spaces 16. For example, the "ARM" market is represented by three market spaces 16*a*. Thus, in the illustrated embodiment, the 42 market spaces 16 represent 18 markets or companies.

Referring to FIG. 2 in conjunction with FIG. 1, the 18 markets represented by the 42 market spaces 16 are grouped into six market groups. Thus, each market space 16 has indicia associated therewith which in the present embodiment comprises color indicia 20 and the market spaces 16 constituting markets which are related to each other are provided with identical color indicia 20. For example, the market spaces 16*a* which represent the "ARM" market are all provided with red color indicia 20. Further, those markets which are related to the "ARM" market are also provided with red color indicia 20. Thus, the market spaces 16 which constitute the "BUD" and "FACK" markets are also provided with red color indicia 20. Thus, the "ARM", "BUD" and "FACK" markets comprise a related group of markets, all of which are similarly marked with red color indicia 20 on their respective market spaces 16. Thus, the market group designated by red color indicia can comprise three companies engaged in, for example, consumer goods manufacturing thereby being related to each other. "ARM" can designate "Arms & Ratchets Machinery Co.", "BUD" can designate "Buds Ultra Duds Co.", and "FACK" can designate "Fackenborth Amalgamated Container Corp.". Thus, the three "red" markets constitute one market group and, in the preferred embodiment, the 18 companies are divided into six market groups as noted above. The particular markets belonging to each respective market group preferably have similar market characteristics, i.e., will react to various market influences in a similar manner according to the game apparatus as described below. For example, small changes in economic or fiscal conditions or in market action pressure will tend to cause larger shifts in value of shares in the "red" market group then in other market groups.

Spaces 14 further include information entry or "Flash" spaces 22, which themselves are segregated into two groups, namely. "Tao Bones" spaces 22*a* (FIG. 2*b*) and "Old Western Onion" spaces 22*b* (FIG. 2*c*). Three "option purchase spaces" 24 (FIG. 2*d*) are located at three respective corners of game board 10 and a start space 26 is located at the fourth corner thereof. The functions of these spaces will become apparent in connection with the discussion of the operation of the game below.

A set of value scales 28 are provided on the central portion of the gameboard 10 in a number equal to the number of market groups represented by market spaces 16. Thus, six value scales 28 are provided on gameboard 10, each value scale having indicia associated therewith, color indicia 30 in the illustrated embodiment, for identifying the particular market group to which that value scale corresponds. For example, the value scale designated 28*a* is provided with red color indicia 30 so that value scale 28*a* corresponds to the "red" market group discussed above.

Referring to FIG. 1 in conjunction with FIG. 3*a*, wherein the value scale 28*a* corresponding to the "red" market group is illustrated, each value scale is divided into a plurality of discrete locations 32. Each of the locations 32 with some exceptions has indicia 34 associated therewith which indicates the value of the shares of the particular markets belonging to the group to which the respective value scale corresponds. One of the locations 32 comprises a START location 32*a* while other locations 32*b* have value altering indicia associated therewith, namely "SPLITZ" indicia. The uppermost location 32*c* is designated "TOP SPLITZ" while the bottom location 32*e* is designated "BANKRUPT". As seen in FIG. 3*a*, the value indicating indicia 34 comprise numbers which progressively increase in the upward direction and a lower set 36 of locations 32 are marked "NO DIV". Finally, one of the locations 32*f* has an "R" associated therewith which also serves to alter the value of the market shares in a manner discussed below.

As seen in FIG. 3*a*, the value scale 28 may also include a similar arrangement of indicia arranged in descending order on the opposite side of the scale. This additional set of indicia is utilized in connection with a more sophisticated form of play of the game.

The game apparatus further includes a plurality of value indicating markers, each marker carrying indicia which associates it with a corresponding one of the markets. Thus, referring to FIG. 3*b*, three value indicating markers 38*a–c* are illustrated, marker 38*a* carrying "ARM" indicia 40*a*, marker 38*b* carrying "FACK" indicia 40*b* and marker 38*c* carrying "BUD" indicia 40*c*. It is understood that a corresponding one of the value indicating markers is provided for each of the markets designated on the game board 10 so that in total there will be 18 of such markers 38. At the beginning of the game, each of the value indicating markers 38 are located on the value scale 28 which represents the market group to which the market designated by the marker 38 belongs. More particularly, each of the value indicating markers 38 are initially located in the START location 32*a* on its respective value scale 28.

Figure 6B:
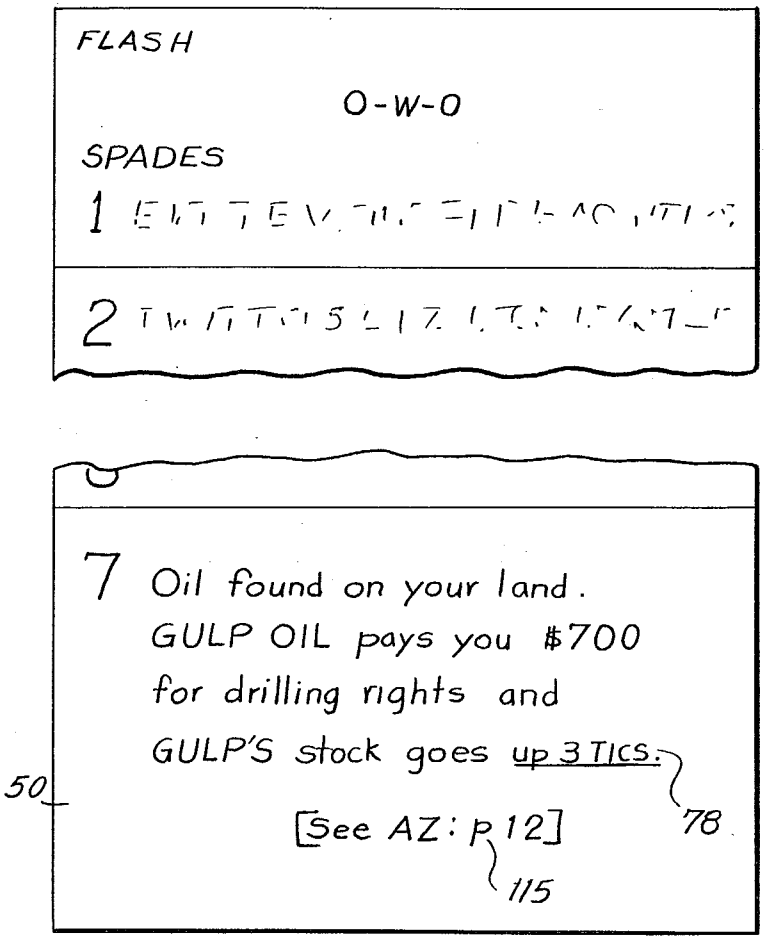
FIG. 6*b* is a view showing one typical market value influence information entry to which a player may be directed by the chance means illustrated in FIG. 5 upon landing on the information entry space shown in FIG. 2*c;*
Figure 6C:
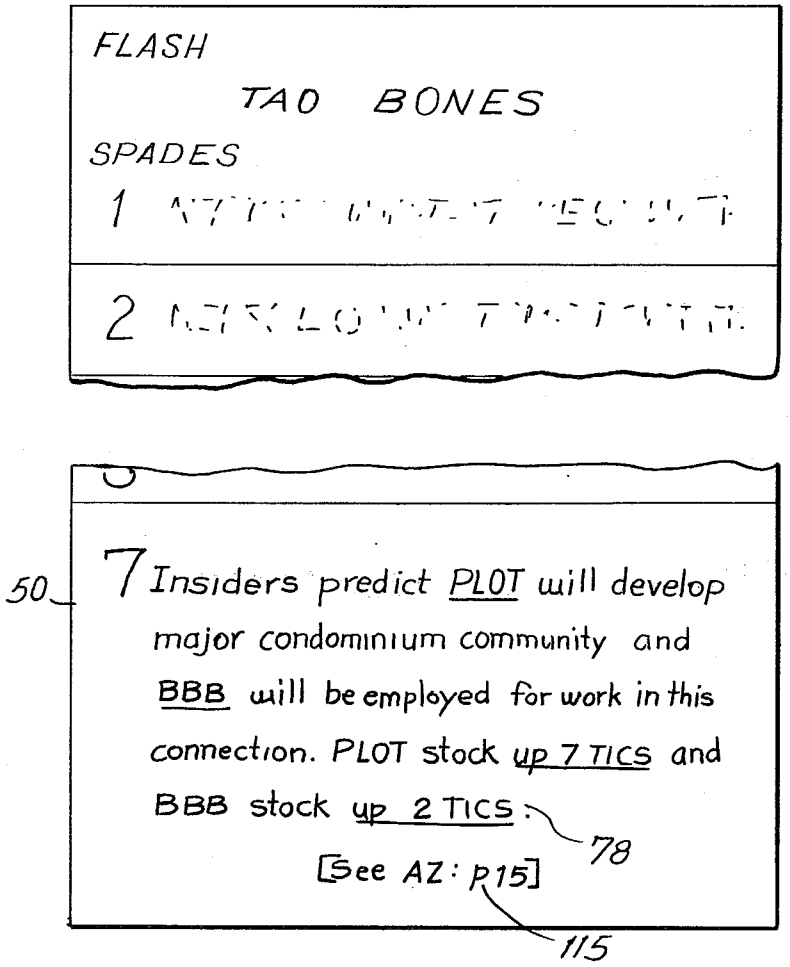
FIG. 6*c* is a view showing one typical market value influence information entry to which a player may be directed by the chance means illustrated in FIG. 5 upon landing on the information entry space shown in FIG. 2*b;*

Generally, the game apparatus of the present invention further includes a market action pressure table ("MAP TABLE") 42 illustrated in FIG. 4, chance means which, in the present embodiment, comprises a deck of cards 44 which are located in the area 46 on gameboard 10, a booklet 48 or the like (FIG. 6*a*) containing a series of market value influence information entries 50, two typical ones of which are illustrated in FIGS. 6*b* and 6*c*, a market revenue and acquisition payment fee schedule 52 (FIG. 7), a bank account statement 54 (FIG. 8*a*), a portfolio account sheet 56 (FIG. 8*b*), option tickets 58 (FIG. 8*c*), rush-order coupons 60 (FIG. 9), a plurality of player tokens 62 (FIG. 10) and apparatus for controlling the movement of the player tokens around the track such, for example, as dice 64 (FIG. 11).

During play of the game, the current value for the shares of each market is designated by the indicia 34 associated with the particular location 32 on the value scale 28 in which the value marker 38 corresponding to that particular market is located. As mentioned above, the opposite facing set of indicia in each value scale is utilized in advanced games only so that for present purposes the reversed scale can be ignored.

As the play of the game progresses, the value of the shares of particular markets fluctuate through the alteration in alignment between the respective value markers and the value indiciating indicia on the value scales. These alterations in alignments are directed from a variety of value altering means which are both internal in the value scales themselves and which are external thereto. Thus, the value altering means include the "SPLITZ" and "R" indicia internal to the value scales 28, value altering indicia associated with the particular track defining spaces 14, value altering indicia associated with particular news or information entries 50 (FIG. 6) and value altering indicia associated with the "MAP TABLE" 42 (FIG. 4).

With respect to the value altering indicia associated with the value scales 28, upon a value marker 28 being located on a "SPLITZ" location 32*b* on a value scale (on an upward move) the value marker 38 is immediately realigned to the location 32 representing the next location above the half-value of the value listed in the "SPLITZ" location 32*b*. Whenever such a split occurs, all players double their recorded holdings for such shares on their respective portfolio account sheets 56. Upon a value marker 38 moving to a "TOP SPLITZ" location 32*c* (the top most location) on a value scale, the value marker 38 is realigned to the "START" location and the player holdings in the market represented by that marker are tripled. Upon a value marker 38 aligning with the lowermost "BANKRUPT" location 32*e*, the market represented by that marker is declared bankrupt and all shares thereof are deleted from player's portfolio account sheets 56. Further, anytime that a value marker 38 is moved to a "BANKRUPT" location on a value scale, all other value markers on the same scale, representing the other markets in the same market group, are lowered in market value by two locations while all other value markers (in other market groups) are lowered on their respective value scales by one position. This feature represents the degrees of reaction to the bad news associated with the bankruptcy of any market. Finally, upon a value marker 38 moving into a "R" location 32*f* on the value scale an automatic "REBOUND" is effected whereby that value marker is realigned downwardly four locations. In other levels of play of the game the "R" location can alter the alignment of the value markers in other ways. For example, in one level, the alignment of the value marker with the "R" location 32*f* temporarily halts all trading in the markets whose value markers become so aligned. Thus, the value altering means provided internally within the respective value scales can alter the values of market shares either singly, of those markets belonging to a single market group, or of all of the markets in the game.

As mentioned above, alterations in the alignments between the value markers 38 and the value indicating indicia 34 on value scales 28 are effected by game elements external to the value scales themselves. Thus, referring to the gameboard 10 illustrated in FIG. 1 and the illustrations of the game spaces shown in FIGS. 2*a*–2*d*, value altering indicia 66 are associated with each of the spaces 14. Such indicia 66 include indicia 68 for indicating the direction of the value change, indicia 70 for indicating the amount of the change and indicia 72 for indicating which markets have their share values changed. The altering of the share values by means of value altering indicia 66 occurs when a player's token lands on a particular space 14. The value will be altered in an upward direction when indicia 68 is a "+" and in a downward direction when indicia 68 is a "−". The amount of the change varies and is represented by the particular numeral which comprises indicia 70. Finally, where indicia 72 comprises a single arc (FIG. 2*a*), the value of the shares of only a single market will be altered, usually the market with which the indicia 66 is associated. Where the indicia 72 comprises a double-arc (see, for example, space 14*a* in FIG. 1), the value markers of all markets belonging to the market group represented by the color indicia 20 of space 14 on which the player token lands are appropriately realigned according to indicia 68, 70. Additionally, the indicia 72 may also comprise a series of arcs 73,75 (see FIG. 13) wherein each arc has a different color corresponding to respective market groups, so that the value markers corresponding to all markets belonging to the series of market groups represented by the different colors will be appropriately realigned according to indicia 68, 70. Finally, where a player token lands on a space wherein the indicia 72 comprises a circle, the value markers of all of the markets are appropriately realigned according to indicia 68, 70.

Thus, it is seen from the above, that the value altering indicia 66 associated with the spaces defining the track or token pathway will alter the share values of single markets, market groups and all of the markets similar to the operation of the value altering indicia internal to the value scales 28.

The share values of the various markets are altered by elements of the game apparatus external to the gameboard itself and which generally simulate the effects of news and other information which affect market share value in real life situations. Thus, as noted above, several pathway defining spaces 14 comprise flash spaces 22, the latter being either of the "TAO BONES" type 22*a* (FIG. 2*b*) or the "OLD WESTERN ONION" (OWO) type 22*b* (FIG. 2*c*). Upon a player's token landing on a "FLASH" space 22, subsequent to altering the positions of the value markers on the value scales in accordance with the indicia 66, the player will draw a card from the card deck 44. In the illustrated embodiment, the card deck 44 comprises a conventional deck of cards so that each card has a numerical designation from one to thirteen and a suit designation, i.e., spades, hearts, clubs or diamonds. Further, two joker cards are normally included. The indicia of the drawn card directs the player to a particular market value influencing information entry 50 contained within the booklet 48 of the market value influence information entries. In this connection, it is noted that two separate sets of entries 50 are provided, one of the sets of entries being consulted when the "FLASH" space 22 landed upon comprises a "TAO BONES" space 22*a* and the other set of entries being consulted when the space landed upon comprises an "OWO" space 22*b*. In this connection, it is preferred that the entries included in the "TAO BONES" section of the booklet 48 contain news items which affect the current values of shares of single markets, market groups or the entire market (see, for example, FIG. 6*b*) while the entries in the "OWO" section contain entries wherein events in the life of the player result in value alterations, value, (e.g., money) payments or receipts by the player, and/or other life simulating events or circumstances which may affect current or subsequent moves or decisions. Drawing a joker card from deck 44 cancels the effect of the value altering indicia 66 of that space or, alternatively, reverses the same.

The market value influencing information entries 50 generally include share value altering indicia 78 which direct the realignment of one or several value indicating markers 38 on their respective value scales 28 which result from the particular news items or entries 50. In this manner the game apparatus of the present invention simulates actual market operation in that news items which are both independent and directly related to the player's life situation will affect the value of the market shares and the player's financial position.

In addition to the value of the market shares being altered by the apparatus described above, namely, by the indicia internal to the value scales 28, the indicia associated with the track or pathway defining spaces 14 and the market value influencing information entries 50, the share values are also altered by the particular market share transactions conducted by the players during the course of the game to thereby simulate the principle of supply and demand. Thus, as in real life market exchange operations, sufficient purchasing activity in a particular market will tend to increase the value of the shares in that market while sufficient sales of shares in a market will tend to depress the value of such shares.

Thus, when a player executes a transaction, i.e., purchases or sells a particular number of shares of a particular market, during the play of the game as described below, the player will consult the "MAP TABLE" 42 (FIG. 4). Referring to FIG. 4, the "MAP TABLE" 42 is divided into sections 80*a*–80*e* corresponding to the particular "fiscal year" during which the share transaction is made. Each circuit of the token pathway 12 by a player token constitutes a fiscal year for that player so that, for example, if the share transaction occurs during the player's second circuit around the token pathway, the player is in his second fiscal year and section 80*b* of "MAP TABLE" 42 will be consulted. The player then consults the second column 82 of "MAP TABLE" 42 in which three ranges of "shares in transaction" are set forth for each fiscal year section and determines which, if any, range the number of shares in his particular transaction falls. Finally, the player consults the third column 84 of "MAP TABLE" 42 wherein value altering indicia 86 are provided in each section 80 corresponding to the three ranges of transacted shares in second column 82. The indicia 86 includes a "+" and "−" indicia indicating that value realignments are in the upward direction for share purchases while value realignments are in the downward direction for share sales. For example, if a player in his second fiscal year purchases 200 shares of a particular market, the value marker 38 corresponding to that market will be moved upwardly 1 tic or location. It should be noted that the share values at the "cusp" of each range are included in two separate ranges. For example, where the number of transacted shares equals 1,000, either the first or second range (for fiscal year two) can be consulted so that the decision is left with the player for choosing the value altering indicia.

It should also be noted that as the game continues and the player's fiscal years progress, increasingly larger share transactions are required to effect the same degree of share value alteration. For example, a purchase of 2,000 shares of a market in the first fiscal year will result in an upward realignment of the value marker corresponding to that market of 3 tics whereas the same purchase of 2,000 shares in the third fiscal year will result in an upward realignment of the value marker of only 1 tic. This feature provides a significant attribute of the game apparatus of the present invention in that it is necessary for the players to increase their capital holdings through skilled investments merely in order to maintain the same level of value altering capability even assuming generally equivalent share values over the years. Such feature closely approximates the action of inflationary pressures which exist in real life market exchanges and further incorporates the principles of supply and demand in conjunction with both time and size of transaction characteristics which traditionally affect changes in market share values.

Before describing the play of the game, reference is made to the option purchase spaces 24 located at the three respective corners of the gameboard 10. As described above each option purchase space 24 includes value altering indicia 66 whereby the share value of all of the markets (by virtue of the full circle indicia 72) are altered in the manner prescribed by indicia 68, 70 upon a player's token landing thereon. Further, upon a player's token landing on an option purchase space 24, all of the game players may purchase an option to buy shares of markets at a price determined by indicia 88 associated with each option space 24 and the current value of the market shares for which the option is purchased. In the illustrated embodiment, indicia 88 comprises a percentage number but it is understood that other indicia may be utilized in this connection such, for example, as fractional numbers. Thus, upon a player token landing on an option purchase space 24, each player in turn may purchase an option to buy a number of shares of a particular market at a price equal to the product of the percentage indicia 88 and the current value of that number of shares of the market as determined by the location of the value indicating marker corresponding to that market on its respective value scale.

As noted above, three option purchase spaces are located at three corners of the gameboard 10 and are designated 24*a*, 24*b* and 24*c* in the direction of movement of the player tokens, i.e., clockwise in FIG. 1. It is noted that the percentage indicia 88 decreases in the direction of movement of the player token so that, for example, indicia 88 in option purchase space 24*a* is 20%, 10% for option purchase space 24*b* and 5% for option purchase space 24*c*. Stated in other terms, the closer the option purchase space 24 is to the "START" space 26 in the direction of movement of the player token, the lower is the percentage indicia 88. In this connection the start space 26 represents the expiration date or point for all options purchased during a particular fiscal year, i.e., during a particular circuit of the token pathway. Thus, for example and as described in detail below, an option on 100 shares of a market selling at $50.00 per share and therefore having a market value of $5,000.00, would cost $1,000.00 if purchased by a player "utilizing" (as described below) option purchase space 24*a*, would cost $500.00 if purchased utilizing space 24*b* and would cost only $250.00 if purchased utilizing space 24*c*.

Purchased options are recorded on option tickets 58 (FIG. 8*c*) in a manner such that the number of shares included in the option is indicated in column 90*a*, the market identifying indicia recorded in column 90*b*, the "STRIKE PRICE", i.e., the market value of the number of shares in the option at the time the option is purchased, in column 90*c*, the fiscal year in which the option is purchased in column 90*d*, the cost of the purchased option in column 90*e*, and the amount received or lost resulting from a sale of the option in column 90*f*.

In the basic play of the game, options may be resold to the exchange during the fiscal year in which the option is purchased and only when the value of the shares included in the option is higher than the "STRIKE PRICE" and in this case the seller receives the difference in these prices from the exchange. Alternatively, the option may be "exercised" whereupon the option holder can buy the number of shares included in the option at the "STRIKE PRICE" regardless of the current value of those market shares. When the shares of a market on which a player holds a valid option splits 2 for 1, i.e., when the value marker of that market becomes aligned with the "SPLITZ" location 32*b* on the value scale or 3 for 1 i.e., when the value marker is aligned with the "TOP SPLITZ" location on the value scale, the number of option shares listed in column 90*a* on option ticket 58 is doubled while the "STRIKE PRICE" listed in column 90*c* is halved.

The above-described game apparatus is sufficient to play the basic form of the game. It is understood, however, that the above-described game elements need not have the particular form described above in connection with the illustrated embodiment. For example, referring to FIG. 12, the value altering indicia 66 associated with the various token pathway defining spaces 14 may be variable either at the beginning of each game or during the course of the game. For example, a plurality of indicia may be provided on a rotatably mounted disk 92 which itself is covered by an opaque member having a window 94 so that the disk 92 can be rotated until the desired indicia 66 is visible through the window 94. Further, the value scales need not comprise an area on the gameboard 10 but may include separate structure. For example, several plastic boards may be provided, each comprising a value scale, having a series of pegs associated therewith for defining the discrete positions corresponding to the locations 32 in the illustrated embodiment. The value markers in this case will constitute small rings having appropriate market identifying indicia associated therewith which fit over the pegs to indicate current market value of the respective market shares. The value scales may alternatively comprise a common disk wherein the indicia 34 are associated around the peripheral area thereof with value markers being provided outside of this area so that their positions align with the indicia to indicate the current value of the market shares. Changes in market share value of all of the shares in the particular market group will be effected by turning the disk an appropriate number of tics while changes in share value of individual markets are effected by moving the particular markers with respect to their disks.

The play of the board game apparatus of the present invention will now be described. Each player simulates an investor and is represented on the token pathway of the board by a particular token 62 (FIG. 10). All player tokens 62 are located at the "START" space 26 at the beginning of the game and each complete clockwise circuit of the pathway by a player's token represents one fiscal year for that player.

Players rotate turns in order with each normal turn comprising three steps:

Step 1: An initial market transaction opportunity for that player;

Step 2: A roll of the dice 64 followed by advancing that player's token the number of spaces indicated by the dice; and Step 3: A landing action based on the type of space on which the tokens lands.

The object of the game is for each player to increase his assets through skillful purchase and sale of shares and options therein in the eighteen markets represented on the gameboard through receipt of profits from sales of market shares and/or dividends, all within the context of the altering of the value of the market shares.

The values of the market shares will change during the course of play according to (1) the value altering indicia 66 associated with the pathway defining spaces 14; (2) the value altering indicia 78 associated with the various market value influencing information entries 50; (3) the value altering indicia 86 associated with the "MAP TABLE" 42; and (4) the realignment of value markers directed by indicia associated with the value scales 28. All of these alterations in market share values are represented by realignments of the value markers 38 with respect to the indicia 34 associated with the value scales 28. The current value of a market share is represented by the particular indicia 34 with which the value marker 38 is aligned and, as described above, alterations in market share values may occur in the shares of a single market, the shares of all markets in a particular market group or in the shares of all markets represented on the gameboard.

Each player begins the game with a specified cash balance such, for example, as $10,000.00, which is noted on the player's bank account statement 54 (FIG. 8*a*). As noted above, the first step in a player's turn comprises an initial market transaction for that player. Such initial transaction can comprise the purchase or sale of shares of one market in which "trading rights" are held, the sale or exercise of an option owned by the player, the purchase of an available rush-order coupon, or a pass, i.e., no transaction.

In connection with the initial player transaction described above, "trading rights" in a particular market are obtained when the player already owns ten shares in that market. Accordingly, it will be understood that on the initial turn at the beginning of the game, a player is limited to the purchase of a rush-order coupon 60 (FIG.

9). The rush order coupon can be purchased for a price equal to the product of $500.00 and the number of players in the game. A player holding a rush-order coupon may make one transaction during another player's turn thereby providing for the player a strategic advantage. In one embodiment of play, the number of rush-order coupons available during any game is equal to one less than the number of players in the game. Upon purchasing a rush-order coupon the current balance shown on the player's bank account statement 54 is appropriately adjusted.

On his first turn, after the player makes his initial market transaction (purchases or does not purchase a rush-order coupon), the dice are rolled and the appropriate token is advanced clockwise the number of spaces indicated by the dice. The third step of the turn is then completed depending upon the nature of the space on which the token lands. More particularly, since all of the spaces 14 have value altering indicia 66 associated therewith, the appropriate value alterations are first made according to indicia 66 as described above. The third step of the turn is then completed in accordance with the type of space on which the token lands. Thus, if the token lands on a space which constitutes a particular market, the player may then purchase or sell any number of shares in that market at the current value thereof as indicated by the location of the particular value marker corresponding to that market on the respective value scale. According to one embodiment of play, a player may sell shares in a market only if he has previously purchased the same, and accordingly, on the first turn, the player can only purchase shares. The player then adjusts his bank account statement 54 to reflect monies paid in the case of a share purchase or monies received in connection with the sale of shares. The cost of the transaction is determined by multiplying the number of shares purchased by the current market value thereof and in connection with purchases of shares, preferably, by adding a brokerage fee (for example of $100.00 for every hundred shares or part thereof).

Upon completing the market transaction, the player consults the "MAP TABLE" 42 to determine the effect (if any) that the purchase or sale of the shares had on the share value. Thus, as explained above, if market shares were purchased in a number found within one of the stated ranges, the value marker corresponding to the market in which shares were purchased is realigned upwardly an amount noted by indicia 86. Similarly, if shares were sold during the market transaction step, the appropriate value markers are realigned downwardly to decrease the value of those shares. As noted above, the "MAP TABLE" is consulted in accordance with the particular fiscal year in which the player is playing.

It is understood that on each turn subsequent to the initial turn of the game, the player may purchase or sell shares of any market in which trading rights (more than ten shares) are held. Such transaction is followed by the appropriate adjustment of the player's current balance on the bank account statement 54 and subsequent alteration in the market share value in accordance with "MAP TABLE" 42.

If after the initial transaction step and second token advance step, the player's token lands on a "FLASH" space, i.e., a "TAO BONES" space 22*a* or "OWO" space 22*b*, the appropriate market share value adjustment is made in accordance with the indicia 66 associated with that space and, subsequently, a card is drawn from the card deck 44. Depending upon which of the "FLASH" spaces 22 has been landed upon, the market value influencing information entries 50 of either the "TAO BONES" series or "OWO" series are consulted. Thus, for example, if after landing on a "OWO" space 22*b* a 7 SPADES is drawn from deck 44, the entry 50 illustrated in FIG. 6*b* applies and the value of the indicated market shares are adjusted according to indicia 78. In the illustrated example, it is seen that the value marker corresponding to the "GULP" market is realigned upwardly three tics on its corresponding value scale.

In connection with a turn wherein a player's token lands on a "FLASH" space 22, it is noted that one of the "FLASH" spaces is provided with indicia 66 which differs somewhat from the indicia 66 associated with the other landing spaces as described above. More particularly, referring to FIG. 1, the "TAO BONES" space 22*a* designated "BONEYARD" has indicia 66 associated therewith represented by two linked elements 98, 100. Element 100 comprises a conventional value altering indicia whereas element 98 represents uncertainty and in the preferred embodiment comprises a "?". Upon a player's token landing on this space in connection with the third step of his turn, the alignment change indicated by element 100 is first effected. Thereafter, each player is given an opportunity to make a market transaction with the appropriate value changes being made in accordance with the "MAP TABLE". Thereafter, a card is drawn from the deck 44. In the preferred embodiment, if this card shows hearts or diamonds, all value markers are realigned downwardly four positions and if otherwise, no additional realignment is made. The appropriate market value influencing information entry 50 is then consulted with appropriate value realignments made. Thus, it is seen that the "BONEYARD" space involves a double level of uncertainty.

If the player token lands on an option purchase space 24, the third step in the player's turn allows each of the players to purchase an option in the shares of any market in which he holds trading rights. The player landing on the option purchase space can purchase the option at a price calculated as described above. The other players may similarly purchase options paying a price determined by the percentage rate listed on the last option space reached by their respective tokens. In a case where the last corner reached by a particular player's token is the start space 26, the option will cost 50% of the value of the shares.

Until the options expire, i.e., while a player is still moving his token in the same circuit of the pathway in which the option was purchased, the option may be sold back to the exchange for its inherent value, i.e., the difference between the strike price and the current value of the market shares in the option, or the option may be excerised so that the shares in the option can be purchased at the strike price. The sale or exercise of options takes place in the first step of a player's turn and comprises the market transaction allowed to the player prior to the roll of the dice. All options which are not exercised or sold back to the exchange before the player's token reaches the start space expire worthless.

At the completion of a player's fiscal year, i.e., when a player's token reaches or passes the start space 26, the player collects dividends of $5.00 per share for each market share owned by him with the exception of those shares whose value markers are aligned with the lower set of value scale locations 36 which indicate "no dividend".

When a particular market becomes bankrupt by the value marker corresponding to that market being aligned with the "bankrupt" location on its respective value scale, that value marker is removed from the gameboard and its corresponding market declared bankrupt. All stock in that market held by all players is declared worthless. Importantly, all other value markers corresponding to markets belonging to the same market group as the bankrupt company are realigned two locations downward and all other value markers are realigned downward one location. If such realignments thereby result in additional market bankrupcies, similar realignments in the value markers will be made. In this manner, an accurate simulation of the market effect that a bankruptcy has in a real life situation is obtained.

It may occur during the course of the play of the game that a player must raise cash to pay an immediate debt at a time when that player is not entitled to make a market transaction, i.e., to sell market shares to obtain capital. In this event, a "forced sale" can be made by that player to the exchange at a price per share indicated by the indicia located four locations below the location at which that market's value marker is located on the value scale and such forced sale will have a market pressure effect on the share value determined by double the normal "MAP TABLE" indicia.

According to another feature of the playing of the game apparatus of the present invention, when the token of a player in a particular fiscal year, i.e., in the particular circuit of the token pathway, is lapped, i.e., passed by the token of a player in a later fiscal year, the lapped player's token is advanced one complete circuit of the token pathway so that it re-lands on the same space. This advancement of one complete circuit or fiscal year comprises a complete landing action, including the collection of dividends, before the third step of the player whose token triggered the lapping action.

The game apparatus of the present invention is advantageous in that it presents various alternatives for ending the game. Thus, the players may agree to end the game after all the players complete a predetermined number of fiscal years or circuits of the board such, for example, as one, three or five. At that point, the assets of the players are totaled utilizing the current market values of the shares owned, the player having the highest total assets being declared the winner. In another possible end game, upon a player achieving total assets of a predetermined amount, for example $1,000,000.00, he is declared the winner and the game ends. Other possible end games will be readily apparent to those having ordinary skill in the art.

Additionally, the game apparatus is suitable for play by a single player and in such case the object becomes for that player to exceed inflation effects. In this end game, the single player's "profit multiple" is computed by determining the multiple by which his current assets exceed his original cash balance. This multiple is then compared with a chart which correlates various profit multiples with associated fiscal years and if the number of actual fiscal years completed by the player is less than the associated fiscal year indication noted on the chart, the player is ahead of inflation and wins.

In a second form of play, strategies in connection with market share transactions are affected by the "control" of single markets or market groups by particular players. Thus, in this form of play, a player controls a particular market by holding more of its shares than any other player at any one of three "share-levels". Thus, a market may be controlled at levels where the player owns more than 100 shares, more than 1,000 shares, or more than 10,000 shares thereof. Further, an entire market group may be controlled by a player through the control of all of the markets that belong to that market group at the same share levels. The lowest share level in which any single market of the market group is controlled will be the level of control for the market group.

Players who control markets or market groups are entitled to claim "trading station revenues" and "acquisition payments". More particularly, "trading station revenues" are due from any player whose token lands on a market space controlled by another player, the amount being payable after the landing player makes the designated value alterations but prior to the player completing his turn by his landing transaction.

The fees payable from the landing player to the controlling player are set forth in the market revenue and acquisition payment fee schedule 52 illustrated in FIG. 7. Thus, referring to FIG. 7, the fees are designated according to the case where a single market is controlled in section 102 and in the case where an entire market group is controlled in section 104. In each case, the revenues will vary according to the particular market group to which the company belongs. Thus, in section 102, it is seen that the revenue figures are grouped according to "red or yellow", "blue or orange" and "green or purple". Further, the fees payable are determined by the level of control designated by column 106 ("loose"), column 108 ("snug") and column 110 ("tight"). In this manner, share purchasing strategy will vary according to the particular market group (color) as well as the share level of control. Thus, for example, if a player lands on a red market space which is controlled at the "loose" level by another player, a fee of $1,000.00 is payable. If all of the red markets are controlled with the lowest level of control, a fee of $3,000.00 is paid.

In order to be able to easily determine whether a particular market is controlled and, if so, by which player, the value marker of a controlled market can be provided with removeable indicia for indicating the player who controls the market at any particular time. Thus, referring to FIG. 3*c*, the value marker **38*a* has a peg opening 119 formed in its upper surface (with the market indicia provided on the side surface thereof) and peg members having the configurations of respective player tokens, e.g., peg members 120, being provided which can be associated with the value marker peg opening. When control changes hands, the peg member 120** is removed and replaced by another peg member designating the new controlling player.

Acquisition payments are due from any player who takes control of a market from another player in a single transaction. Such payment represents a severance bonus for the player losing control and legal fees for the player taking over control. The acquisition payment is the same amount that would have been due as revenues had the player landed on the market space representing the company whose control is changing hands.

In connection with the form of the game play which includes the market control features described above, additional features are included. For example, before the first normal turn of the game, the players will privately write down details of three market transactions, i.e., share purchases (with the trading rights requirements being temporarily suspended). All players will then reveal these transactions simultaneously and the transactions are then executed in a normal fashion. The appropriate "MAP TABLE" effects are applied. Further, one of the option purchase spaces, e.g., space 24*b* may be provided with indicia 110 (FIG. 3*d*) which indicates that upon a token landing on this space, each player may elect to either purchase an option according to normal game procedure or receive a $5,000.00 "rebate" from the exchange.

As mentioned above, the game apparatus of the present invention can be played at various levels of sophistication in each form. The game play described above comprises the first level game. The second level games have further refinements of option and dividend actions, add short-selling and other sophistications. The level three games incorporate additional investment choices such, for example, as corporate bonds, convertible bonds, preferred stock, special warrants, certificates of deposit, etc. The details of play in these levels are not included here since they go beyond the scope of the embodiments described.

Certain features of advanced levels of play, however, should be noted. Firstly, a sophistication of the market value information influencing entries 50 described above in connection with FIGS. 6*a*–6*c* may be introduced such that an individual selection from the card deck 44 directs the player whose token has landed on a flash space 22 to more than a single one of the information entries 50 contained within booklet 48. In this manner, each level of advancement of game play is associated (either alternatively or cumulatively in different advancement levels) with entire sets of information entries so that successively more sophisticated game forms will include progressively more sophisticated information entries.

Secondly, in a related advanced variation, as seen in FIGS. 6*b* and 6*c* the information entries 50, in addition to including value altering indicia 78, further include cross-referencing indicia 115 which refer the players to additional information entries (not shown). Thus, the cross-referencing indicia 115 in FIG. 6*b* directs the player to "AZ:p12". Thus, the player after effecting the value changes specified by indicia 78 refers to an additional information entry designated by indicia 115 which directs the player to pay or receive money, effect additional market value changes, forego succeeding turns, refrain from transactions in succeeding turns, etc. These additional information entries will refer to yet additional information entries for use in connection with the play of the game apparatus in the third level of sophistication. Separate entries are provided for the "TAO BONES" entry series and the "OWO" entry series.

According to another feature of advanced level of play, each market and/or market group has associated therewith a pre-assigned end value for strategic purposes. For example, "ARM", "FACK", and "BUD" may be given end values of "2", "3" and "3", respectively. The indicia may be provided on the market defining space such as indicated at 117 in FIG. 2*a*. The red market group may similarly be given an end value of "10". In this level of play, the player controlling single markets or market groups at a designated stage of play is credited with end-value points and the game winner is that player in control of the greatest number of points (rather than the player with the greatest dollar-based assets).

In still another advanced variation of game play, the individual spaces defining the gameboard track as illustrated in FIGS. 2, 12 and 13 comprise separate individual tiles adapted to be located over designated areas printed on the gameboard. In this variation the order of the spaces may be changed during the course of play or from game to game by rearranging the tiles over the designated printed areas. For example, in one mode of play, the player may change the order of spaces (markets) at certain times determined by the game rules. In another mode of play, each player can rearrange the tiles along the pathway prior to his turn.

In a further advanced game variation, each of the market defining spaces and/or market groups has variable dividend value indicia associated therewith for indicating the dividend value of the markets corresponding thereto at a particular time during the course of play. For example, each market space may be provided with a rotatable disc like that illustrated in FIG. 12 wherein the indicia 66 is utilized to represent the current per-share dividend rate for the market or market group. The dividend rate may change during the course of play according to token landings and/or other events specified by the rules.

From the above, it is seen that the board game apparatus of the present invention provides for a unique interplay of novel structures which together combine to simulate aspects of real world market operations to provide for both entertainment and educational values during play. Thus, the play of the game combines skill, strategy, chance and decision making factors which simulate the concepts, procedures, dynamics and influences which are characteristic of a real world market exchange. Further, the combination of the various means by which the value of market shares are altered permits the game apparatus to be played at various levels of sophistication and in various forms so that novices in the particular market simulated by the board game apparatus as well as veterans of those markets can play the game both for entertainment and educational purposes.

Obviously, numerous modifications and variations of the present invention are possible in the light of the above teachings. Accordingly, it is understood that within the scope of the claims, the invention may be practiced otherwise than as specifically disclosed herein.

What is claimed is:

1. Board game apparatus comprising:

a first playing area on a game board having a continuous track defined by a plurality of spaces, each of a majority of said spaces constituting a market representing a plurality of ownership shares, at least two of said markets belonging to one of a plurality of market groups and each market having first indicia associated therewith for identifying a particular market and second indicia for identifying the particular market group to which said particular market belongs;

a set of value scales, each of said value scales being associated with a corresponding one of said market groups and having indicia associated therewith corresponding to said second indicia for identifying the particular corresponding market group, and wherein each of said value scales has associated therewith at discrete locations thereon a series of indicia for indicating the value of ownership shares of the particular markets which belong to the corresponding market group;

a plurality of value indicating marker means, each of said value indicating marker means being associated with a corresponding one of said markets and having indicia associated therewith corresponding to said first indicia for identifying the particular corresponding market, each respective value indicating marker means being moveably located on a respective value scale relative to the value indicating indicia thereon, which value scale corresponds to the market group to which the market associated with the respective value indicating marker means belongs, to indicate a particular value for shares of the corresponding market;

value altering means for directing the movement on the respective value scales on which they are located relative to the value indicating indicia thereon of one of the value indicating marker means, of all of the value indicating marking means belonging to a particular market group, and of all of the value indicating marker means, to thereby alter the values of the shares of markets corresponding thereto;

at least one player token for movement on the spaces around said track whereby players purchase, sell and otherwise trade shares in said markets as the tokens move around said track; and token movement control means.

2. Apparatus as recited in claim 1 wherein said value altering means comprise value altering indicia associated with each of at least several of the track defining spaces for directing movement of certain value indicating marker means upon a player token landing on the space with which the indicia is associated and wherein a first portion of said value altering indicia comprises indicia means for directing the movement of the value indicating marker means corresponding to the particular market constituted by the space with which the indicia is associated, a second portion of said value altering indicia comprises indicia means for directing the movement of all of the value indicating marker means corresponding to the markets which belong to the market group to which the particular market constituted by the space with which the indicia is associated belongs, and a third portion of said value altering indicia comprises indicia means for directing the movement of all of the value indicating marker means.

3. Apparatus as recited in claim 1 further including value altering indicia associated with said value scales at at least one of the discrete locations at which value indicating indicia is associated and wherein said value altering indicia directs a realignment of a value indicating marker means upon the latter moving into alignment with the discrete location with which said value altering indicia is associated.

4. Apparatus as recited in claim 1 wherein a player can control a particular market by owning a greater number of shares thereof than the other players and can control a market group by controlling all of the markets belonging thereto and further including a data table having fee schedule indicia thereon directing the payment of a fee from a first player to a second player upon the first player's token landing on a space constituting a market which is controlled by the second player and wherein the fees set forth in the fee schedule of said data table are categorized according to the particular market group to which the controlled market belongs, according to whether the market alone is controlled or whether the market group to which the market belongs is controlled, and according to the number of shares of the controlled market owned by the controlling player and further including player indicating means for identifying a particular player adapted to be affixed to the value indicating marker means corresponding to controlled markets, whereby upon a player obtaining control of a market, said player indicating means identifying that player are affixed to the value indicating marker means corresponding to that controlled market so that the player controlling that market may be easily visually determined.

5. Apparatus as recited in claim 1 further including a set of rush-order coupons having indicia associated therewith for allowing a player to make a game transaction out of the normal turn sequence.

6. Apparatus as recited in claim 1 wherein said value altering means comprise value altering indicia for directing the movement of the value indicating marker means, said indicia being associated with respective ones of a plurality of market value influencing information entries and wherein at least one of the track defining spaces comprises information entry spaces and wherein said game apparatus further includes chance means for operation by a player upon landing on one of said information entry spaces for directing the player to at least one of said market value influence information entries; said chance means comprising a deck of cards, each of said cards having indicia associated therewith for directing the player to at least one of said market value influence information entries, said value altering indicia and respective value influencing information entries being contained in a structure separate from said deck of cards, and wherein said value influence information entry is associated with identifying indicia corresponding to said indicia associated with said cards.

7. Apparatus as recited in claim 6 wherein said track defining spaces include a plurality of said information entry spaces, each of which belongs to one of at least two distinct groups, each group of information entry spaces being associated with its own distinct set of market value influencing information entries by the chance means.

8. Apparatus as recited in claim 1 wherein at least one of the track defining spaces comprises an option purchase space, said option purchase space having indicia associated therewith for determining the purchase price of an option to purchase shares in a market, said purchase price determining indicia comprising one of a percentage or fraction, whereby upon a player landing on an option purchase space, an option to purchase a number of share of a particular market may be purchased at a price equal to the product of the percentage or fraction and the current price of that number of shares of the market as determined by the location of the value indicating marker means corresponding to that market on the value scale.

9. Apparatus as recited in claim 8 wherein a plurality of option purchase spaces are provided, each being separated from the others by intervening spaces and wherein said track has a start space designating the point at which any options purchased by a player expire upon that player's token moving past the start space, the percentage or fraction associated with each option purchase space being smaller for the option purchase spaces which are closer in the direction of token movement to the start space.

10. Apparatus as recited in claim 1 wherein said value altering means comprise a table associated with said apparatus having value altering indicia printed thereon, said value altering indicia including a first group of indicia indicative of the number of shares purchased or sold in a transaction and a second group of indicia corresponding to the first group of indicia indicative of the extent of movement of the value indicating marker means corresponding to the number of shares purchased or sold in a transaction, said value altering indicia being for directing the movement of the value indicating marker means in a manner such that purchases of shares of a market increase the value of shares of that market to an extent corresponding to the number of shares purchased while sales of shares of a market decrease the value of shares of that market to an extent corresponding to the number of shares sold.

11. Apparatus as recited in claim 10 wherein the value altering indicia further directs that the extent to which the value of a market increases or decreases as a result of purchases or sales, respectively, of shares in that market is further a function of the progress of the player token.

12. Apparatus as recited in claim 11 wherein said value altering indicia directs that the extent of increase or decrease in the value of shares of a market resulting from purchases or sale, respectively, of equal numbers of shares in that market is smaller in later track circuits than in earlier track circuits.

13. Apparatus as recited in claim 1 wherein each of said market defining spaces and/or market groups has end value indicia associated therewith for indicating a value of the markets corresponding thereto at the conclusion of play of the game.

14. Apparatus as recited in claim 1 wherein each of said plurality of spaces defining said continuous track constitutes a separate tile member whereby the sequence of track spaces can be varied during the course of play or from one game to another.

* * * * *